US005397006A

United States Patent [19]

Terrell

[11] Patent Number: 5,397,006

[45] Date of Patent: Mar. 14, 1995

[54] STORAGE TRAY SYSTEM

[76] Inventor: William H. Terrell, 76 Crest Rd., Ridgewood, N.J. 07450

[21] Appl. No.: 81,783

[22] Filed: Jun. 22, 1993

[51] Int. Cl.[6] ..... A47F 5/00

[52] U.S. Cl. ..... 211/88; 211/74; 248/311.2

[58] Field of Search ..... 211/88, 74, 94, 87; 248/311.2, 312.1

[56] References Cited

U.S. PATENT DOCUMENTS

| | | | |
|---|---|---|---|
| 679,807 | 8/1901 | Werum | 211/88 |
| 1,446,036 | 2/1923 | Dodd | 248/312.1 |
| 2,266,294 | 12/1941 | Allderdice | 248/311.2 |
| 2,353,365 | 7/1944 | Sanford . | |
| 2,450,722 | 10/1948 | Drije | 248/311.2 |
| 2,879,966 | 3/1959 | Carroll . | |
| 2,967,691 | 1/1961 | Lehnbeuter et al. | 248/311.2 |
| 3,069,019 | 12/1962 | Schuster . | |
| 3,285,686 | 11/1966 | Beaver . | |
| 3,502,294 | 3/1970 | Kalbow et al. | 248/311.2 |
| 3,698,565 | 10/1972 | Weber . | |
| 3,886,698 | 6/1975 | Raith et al. . | |
| 4,085,867 | 4/1978 | Heller . | |
| 4,215,840 | 8/1980 | Babberl | 248/311.2 X |
| 4,694,965 | 9/1987 | Parnell . | |
| 5,074,504 | 12/1991 | Minnick . | |
| 5,323,917 | 6/1994 | Johnson et al. | 248/311.2 X |
| 5,328,037 | 7/1994 | Fujii | 211/88 X |

*Primary Examiner*—Robert W. Gibson, Jr.
*Attorney, Agent, or Firm*—Samuelson & Jacob

[57] ABSTRACT

A storage tray system includes a plurality of storage trays each of which has a receptacle bounded by vertical walls, each having an inner surface, and a lip extending along at least one of the walls of the receptacle and projecting upwardly to be engaged within a horizontal slot between two mounting plate portions of a mounting plate such that the lip is juxtaposed with one mounting plate portion, above the slot and behind the one mounting plate portion, and a wall of the receptacle abuts the other mounting plate portion, below the slot and in front of the other mounting plate portion, with the inner surface of the abutting wall essentially flush with the corresponding outer surface of the one mounting plate portion for unrestricted access to the receptacle and for an integrated, aesthetically pleasing appearance.

11 Claims, 6 Drawing Sheets

STORAGE TRAY SYSTEM

The present invention relates generally to storage tray systems and pertains, more specifically, to an improvement in storage tray systems enabling the selection of any of a number of storage trays for the convenient and compact storage and the selected transportation of a variety of items, as well as easy access to the stored items.

A wide variety of storage tray systems is available in which storage trays are mounted on a vertical surface, such as a wall, for use in holding various items for storage at a location convenient to the use of the stored items. For example, relatively small parts very often are stored in bin-like trays secured to a wall adjacent a work station for maintaining a source of small parts at a location convenient to a worker at the work station.

It is advantageous to have available a storage tray system which provides a maximum of storage capacity within a minimum of space, without sacrificing ease of access to the items being stored. The present invention provides such a system and attains several objects and advantages, some of which are summarized as follows: Enables a high degree of versatility for accommodating a wide variety of items to be stored in a storage tray system; provides maximum storage capacity in a minimum of space, with ease of access to items stored in the system; enables ease of securement and release of storage trays for any desired arrangement of trays, as well as for the convenient transport of items in a tray to a remote location; provides optional tray covers for additional security and protection of the items being stored and transported; eases the accommodation of items of various dimensions for storage in the system and enables essentially unrestricted access to the items; provides an aesthetically pleasing appearance adapted for more widespread acceptance and use; enables a relatively simple construction for economical manufacture and relatively low cost; provides a rugged construction for exemplary performance over a long service life.

The above objects and advantages, as well as further objects and advantages, are attained by the present invention which may be described briefly as an improvement in a storage tray system in which a plurality of storage trays each include a receptacle bounded at least partially by a generally vertical wall having a generally vertical inner surface along the receptacle, an opposite outer surface and an upper peripheral edge, for enabling the mounting of a selected number of such trays in selected positions adjacent one another on an essentially vertical mounting plate, the improvement comprising: a lip extending generally horizontally along at least a portion of the upper peripheral edge of the generally vertical wall and projecting vertically upwardly from the upper peripheral edge; the mounting plate including an upper plate portion having an upper front surface and an upper rear surface located rearward of the upper front surface, a lower plate portion having a lower front surface and a lower rear surface located rearward of the lower front surface, and a generally horizontal slot between the upper plate portion and the lower plate portion; the lower plate portion being staggered rearwardly relative to the upper plate portion, and the lip being spaced horizontally from the inner surface of the wall of the receptacle such that upon insertion of the lip into the slot with the lip juxtaposed with the upper rear surface of the upper plate portion, the inner surface of the wall of the receptacle is essentially flush with the upper front surface of the upper plate portion while the outer surface of the wall of the receptacle abuts the lower front surface of the lower plate portion to support the storage tray on the mounting plate.

The invention will be understood more fully, while still further objects and advantages will become apparent, in the following detailed description of preferred embodiments of the invention illustrated in the accompanying drawing, in which.

Figure 1:
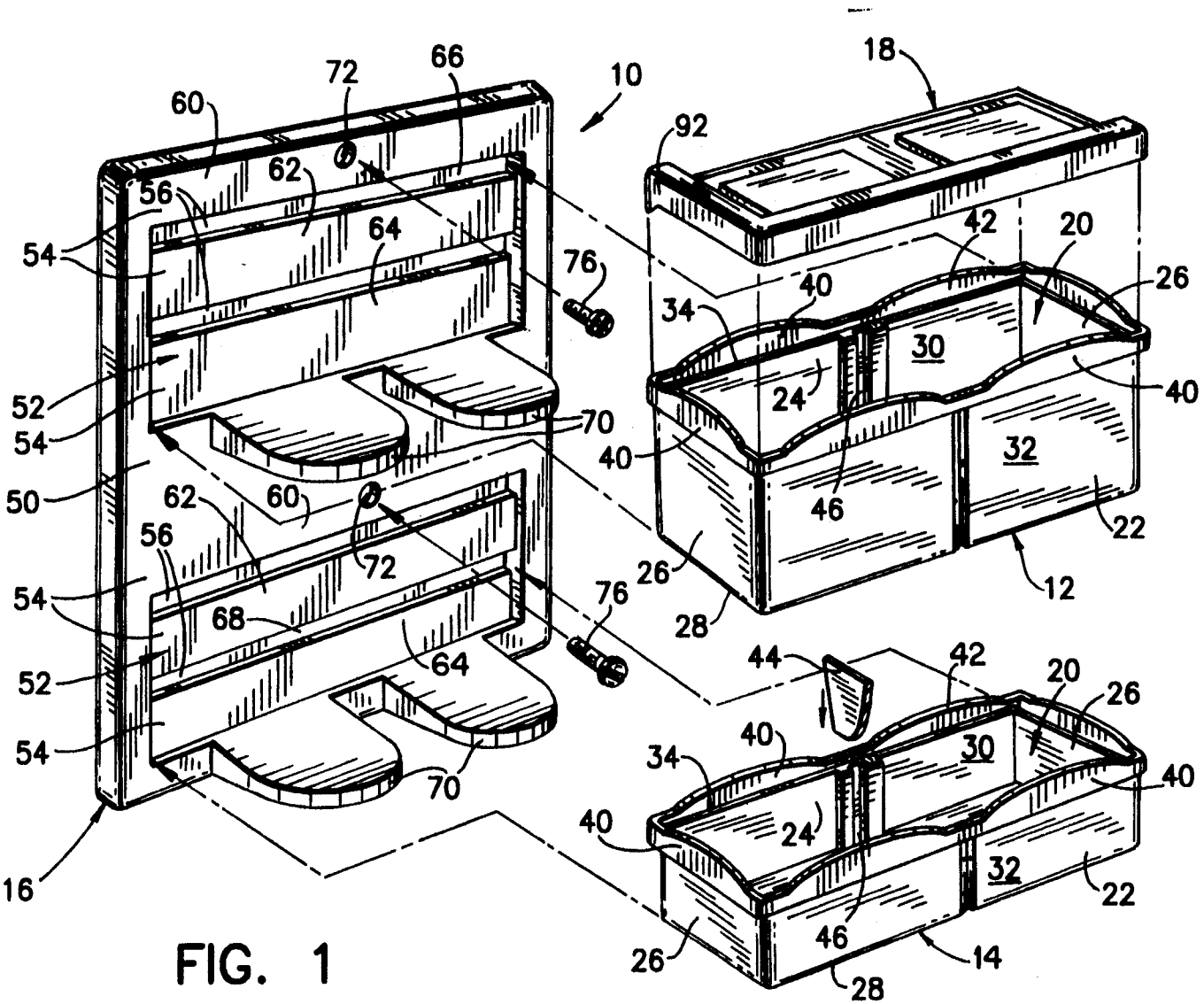
FIG. 1 is an exploded perspective view of a storage tray system constructed in accordance with the present invention, showing storage trays about to be mounted upon a mounting plate, and an optional storage tray cover.

Referring now to the drawing, and especially to FIG. 1 thereof, a storage tray system constructed in accordance with the present invention is illustrated at 10 and is seen to include a plurality of storage trays 12 and 14 about to be affixed to a mounting plate 16. A cover member 18 optionally is to be placed on storage tray 12. Storage trays 12 and 14 each are constructed in a bin-like configuration including a receptacle 20 surrounded by a front wall 22, a rear wall 24 and opposite side walls 26, all extending essentially vertically upwardly from a closed bottom wall 28. Each of the walls 22, 24 and 26 includes an inner surface 30 extending along the receptacle 20, an opposite outer surface 32, and an upper peripheral edge 34. A lip 40 extends generally horizontally, preferably along the upper peripheral edge 34 of each of the walls 22, 24 and 26, and projects vertically upwardly from each peripheral edge 32 to an uppermost edge 42. Uppermost edge 42 has a convex, generally arcuate profile configuration, for purposes which will be described in further detail below. Dividers 44 (also see FIG. 4) may be inserted into opposite complementary grooves 46 located in the front wall 22 and in the rear wall 24 to divide the receptacle 20 into smaller compartments for facilitating the storage and handling of smaller items. Thus, storage trays 12 and 14 are similar in construction, with the exception that storage tray 12 is deeper than shallower storage tray 14.

Mounting plate 16 has a facia 50 which includes sites 52 for the reception of the storage trays 12 and 14, the sites 52 being arranged vertically one above the other.

Each site 52 includes plate portions 54 extending horizontally and located vertically one above the other, with horizontally extending slots 56 placed between adjacent plate portions 54. For purposes of describing the operation of the plate portions 54 and the slots 56, each plate portion 54 will be designated arbitrarily as an upper plate portion 60, a lower plate portion 62 below the upper plate portion 60, and a further plate portion 64 below the lower plate portion 62. Slot 66 extends horizontally between the upper plate portion 60 and the lower plate portion 62, while further slot 68 extends horizontally between further plate portion 64 and lower plate portion 62, at each site 52. A plurality of auxiliary support pads 70 project horizontally outwardly from facia 50, just beneath each further plate portion 64. Screw holes 72 are provided in facia 50 for enabling mounting of the mounting plate 16 to a vertical surface.

Figure 2:
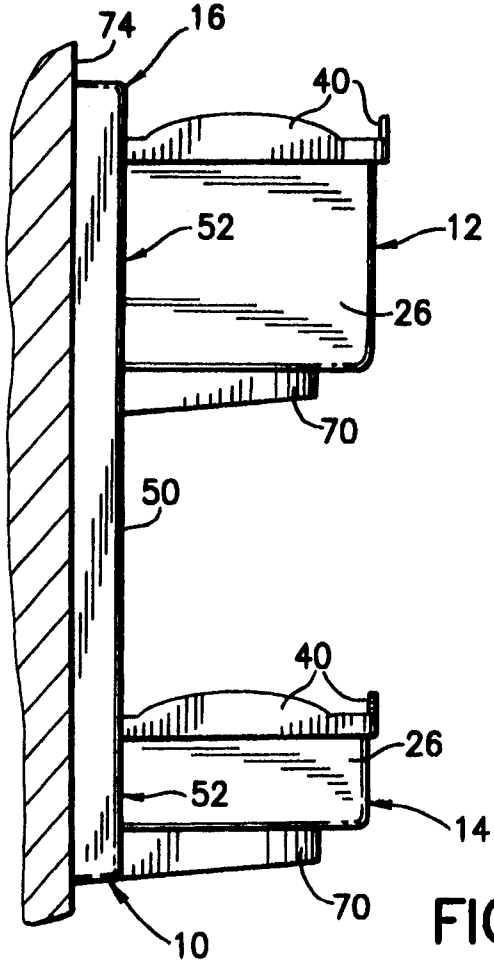
FIG. 2 is a side elevational view of the storage tray system with the mounting plate secured to a vertical surface and the storage trays affixed to the mounting plate.
Figure 3:
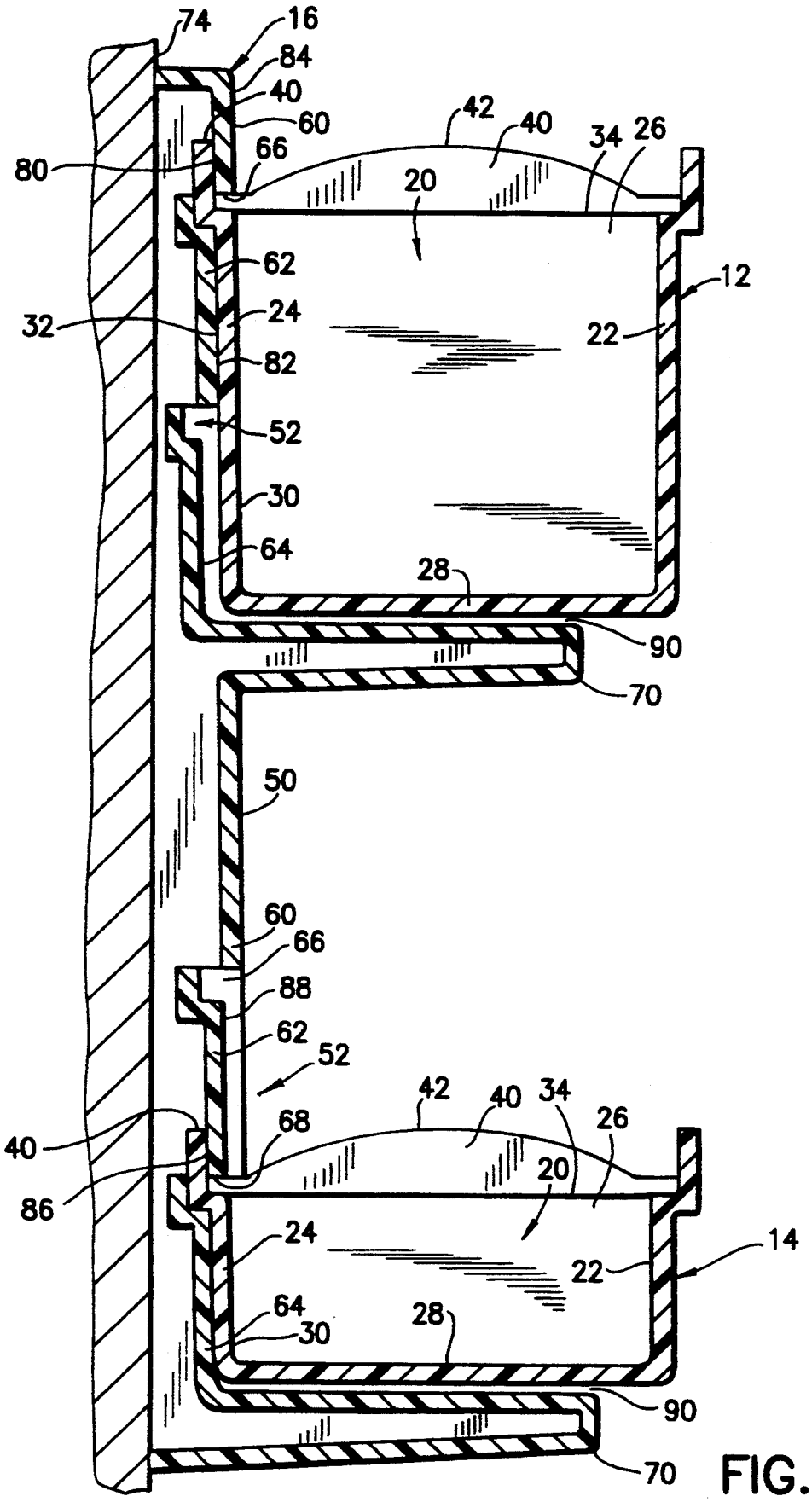
FIG. 3 is an enlarged cross-sectional view of the storage tray system as shown in FIG. 2.

Turning now to FIGS. 2 and 3, as well as to FIG. 1, mounting plate 16 is mounted upon a vertical surface in the form of a wall 74, as by running screws 76 through screw holes 72 and into wall 74. Alternately, mounting plate 16 may be secured to wall 74 by means of a separate mounting bracket (not shown) or an adhesive, or the like. Once the mounting plate 16 is secured to wall 74, storage trays 12 and 14 may be affixed to the mounting plate 16 at a selected site 52 by merely inserting lip 40 into a corresponding slot 66 or 68 at the site 52 to juxtapose the lip 40 with the rear surface of the corresponding plate portion. Thus, as best seen in FIG. 3, the deeper storage tray 12 is affixed to the mounting plate 16 by inserting lip 40 into slot 66 and bringing the lip 40 into juxtaposition with the upper rear surface 80 of the upper plate portion 60. At the same time, the outer surface 32 of the rear wall 24 of the receptacle 20 of storage tray 12 is brought into abutment with the lower front surface 82 of the lower plate portion 62 of the site 52. In this manner, the storage tray 12 is suspended from and is affixed to the mounting plate 16.

The lip 40 is spaced horizontally rearward relative to the inner surface 30 of the wall 24 of the receptacle 20 and the lower plate portion 62 is staggered rearwardly relative to the upper plate portion 60 so that upon insertion of the lip 40 into slot 66 and juxtaposition of the lip 40 with the upper rear surface 80, the inner surface 30 of the wall 24 of the receptacle 20 is rendered essentially flush with the upper front surface 84 of the upper plate portion 60. The flush relationship between the inner surface 30 of the wall 24 and the upper front surface 84 of the upper plate portion 60 enables essentially unrestricted access to the receptacle 20 while providing an aesthetically pleasing integrated appearance in the assembled storage tray 12 and mounting plate 16. The convex, generally arcuate configuration of the uppermost edge 42 of the lip 40 is preferred in that the particular configuration eases insertion of the lip 40 into a corresponding slot 66 or 68, as well as selective removal, while providing structural integrity and safe handling, as well as aesthetic appeal.

The provision of two slots 56 and three plate portions 54 at each site 52 enables the mounting of either a deeper storage tray 12 or a shallower storage tray 14 at a site 52, or a selected mix of storage trays 12 and 14, for almost any desired arrangement of storage trays. Accordingly, in mounting the shallower storage tray 14 at a site 52, lip 40 is inserted into slot 68 and juxtaposed with the lower rear surface 86 of the lower plate portion 62, and the outer surface 30 of wall 24 of receptacle 20 of the storage tray 14 abuts the further plate portion 64 to support the storage tray 14 on the mounting plate 16, with the inner surface 30 of wall 24 of the receptacle 20 essentially flush with the lower front surface 88 of the lower plate portion 62. It will be apparent that any number of sites 52 may be provided in a variety of arrangements on a single mounting plate 16 for creating storage tray systems of different capacities and varying appearance.

Figure 4:
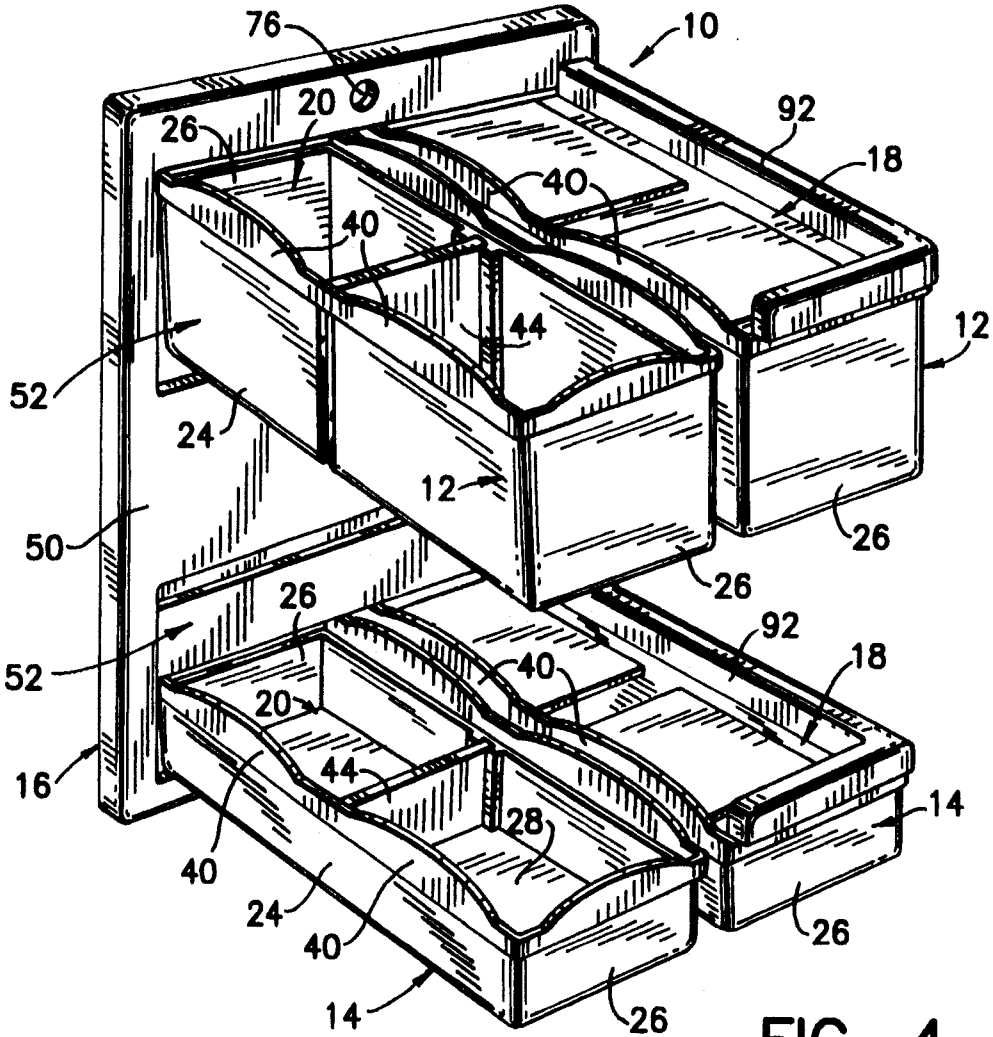
FIG. 4 is a perspective view showing an alternate arrangement of storage trays affixed to the mounting plate.

In the preferred configuration of the storage trays 12 and 14, the receptacle 20 has a generally rectangular perimeter with the front wall 22 and the rear wall 24 being longer than the side walls 26, and all of the walls extending serially around the perimeter of the rectangular receptacle 20. The lip 40 extends along at least the rear wall 24 and one side wall 26 so that each storage tray 12 or 14 selectively is mounted upon the mounting plate 16 with a longer wall 24 adjacent the mounting plate 16, as illustrated in FIGS. 1 through 3, or with a shorter wall 26 adjacent the mounting plate 16, as shown in FIG. 4. The added versatility enables the selective mounting of four storage trays 12 or 14, thereby selectively increasing the capacity of the system. It is noted that the storage trays 12 and 14 are suspended from and are attached to the mounting plate 16 as described above, with a slight amount of clearance 90 between the bottom wall 28 of the receptacle 20 and the corresponding auxiliary support pads 70. Once each receptacle 20 is filled with items to be stored in a storage tray 12 or 14, the storage tray may tend to droop under the load, especially in the arrangement of FIG. 4 wherein the storage trays 12 and 14 project forward further than in the arrangement of FIGS. 1 through 3. The droop is controlled by the provision of the support pads 70 which bolster the storage trays 12 and 14 against the load.

In the preferred configuration, the lip 40 extends along all four walls 22, 24 and 26, around the entire perimeter of the receptacle 20. In this manner, versatility is increased while the lip 40 provides a means by which to secure the optional cover member 18 in place over the receptacle 20. Thus, cover member 18 has a rectangular configuration essentially complementary to the receptacle 20 and includes a channel 92 extending along at least two sides of the cover member 18. Corresponding portions of the channel 92 and the lip 40 are complementary so that the lip 40 is received within the channel 92 to secure the cover member 18 in place over the receptacle, as seen in FIG. 4. By restricting the channel 92 to two sides of the cover member 18, the lip 40 is exposed along both a longer wall 22 and a shorter wall 26 for enabling mounting of a storage tray 12 or 14 in either of the arrangements illustrated in FIGS. 1 through 3, and in FIG. 4, with the cover member 18 in place over the receptacle 20. In this manner, the items stored in the receptacle 20 are protected against dust, dirt and the like, and against spilling.

The storage trays 12 and 14, the mounting plate 16 and the cover member 18, as well as the dividers 44, are economically manufactured, the preferred method being by molding the component parts of a synthetic polymeric material. The material may be opaque, in a variety of colors, or may be transparent to facilitate visual identification of the items stored in the receptacles 20. The construction of the component parts enables economy, as well as aesthetic appeal, and assures that the component parts are rugged and will provide exemplary performance over a long service life.

Figure 5:
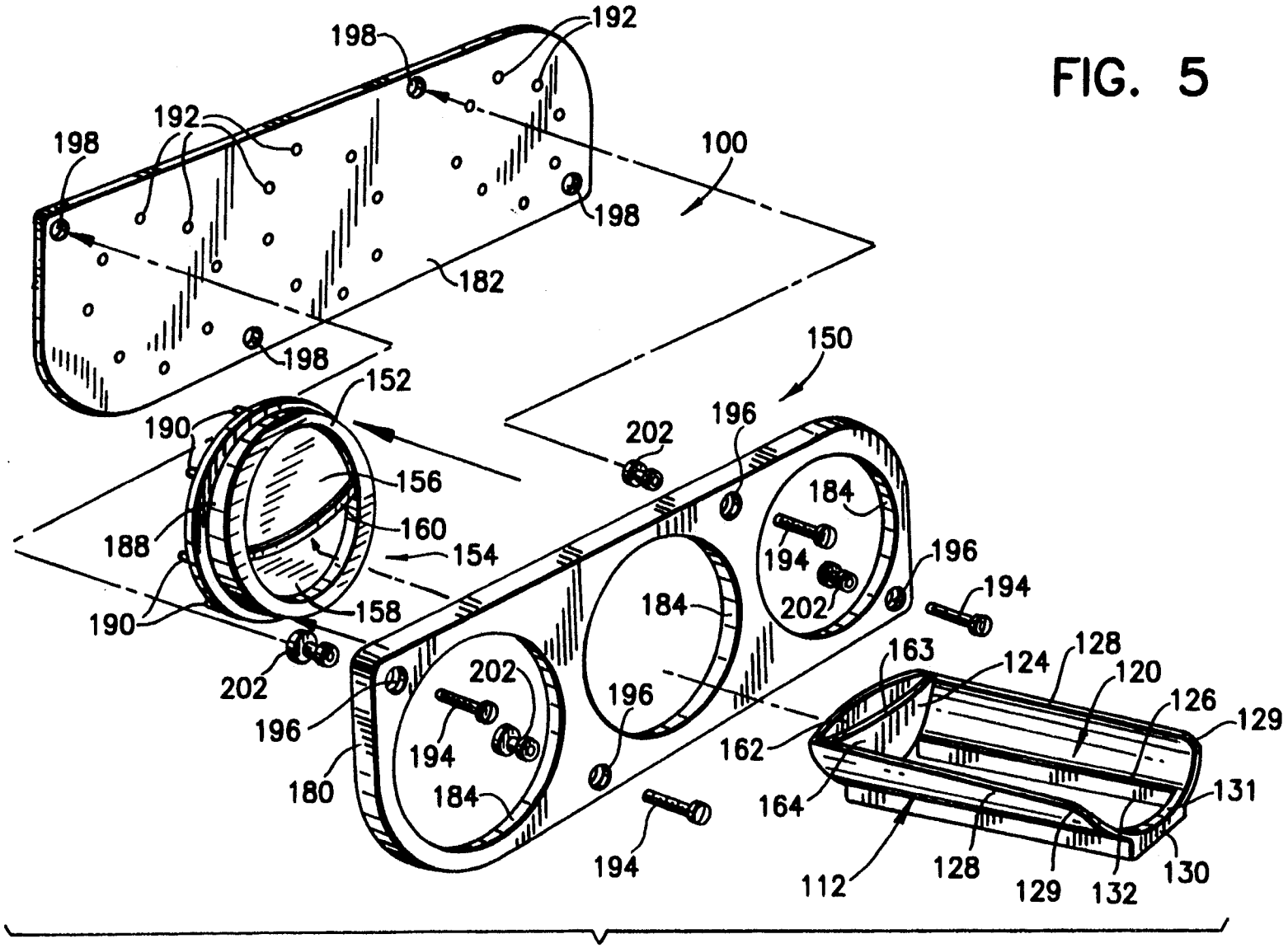
FIG. 5 is an exploded perspective view of another storage tray system, illustrating another embodiment of the present invention.
Figure 6:
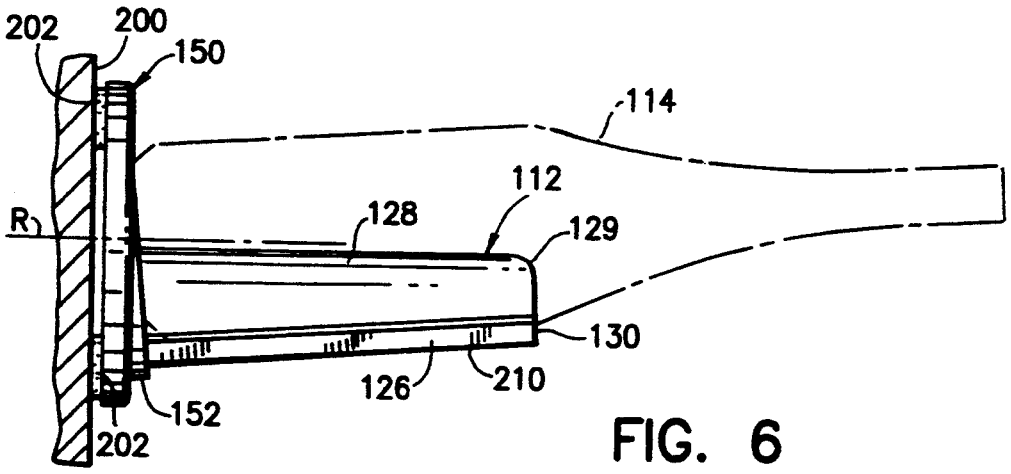
FIG. 6 is a side elevational view showing the storage tray system of FIG. 5 with the mounting plate secured to a vertical surface and a storage tray affixed to the mounting plate.
Figure 7:
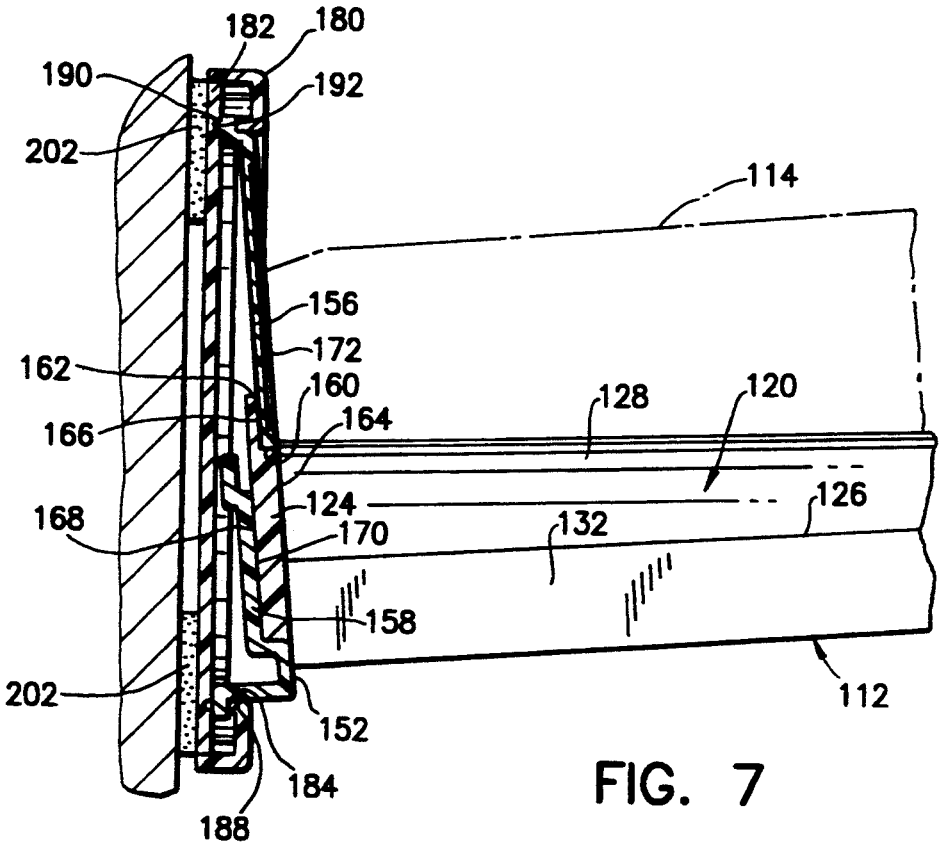
FIG. 7 is an enlarged fragmentary cross-sectional view with a storage tray mounted on the mounting plate, as seen in FIG. 6.

Turning now to FIGS. 5 through 7, another embodiment of the invention is provided for the storage of containers and is illustrated in the form of a rack 100 in which each storage tray 112 has a configuration for storing a generally cylindrical container such as a wine bottle 114. Storage tray 112 includes a receptacle 120 having a semi-cylindrical cross-sectional configuration in vertical planes for accommodating wine bottle 114. A rear wall 124 extends vertically upwardly from a bottom wall 126, and opposite side walls 128 project outwardly from the rear wall 124 and are contoured to provide the desired cross-sectional configuration of the receptacle 120. In addition, the side walls 128 are rounded at 129 to eliminate any protruding sharp edges. A front wall 130 opposite the rear wall 124 provides a relatively blunt end which militates against injury from potential contact while increasing the structural integrity of the storage tray 112. An opening 131 in the front wall 130 enables the wine bottle 114 to be accommodated by protruding beyond the receptacle 120 of the storage tray 112. An elongate aperture 132 in the bottom wall 126 allows for free circulation of ambient air around a stored wine bottle 114 and prevents the accumulation of dust, dirt or other unwanted matter in the receptacle 120.

A mounting plate in the form of a mounting plate assembly 150 includes a mounting hub 152 which provides a site 154 for mounting the storage tray 112 and includes an upper plate portion 156, a lower plate portion 158 and a generally horizontal slot 160 between the upper plate portion 156 and the lower plate portion 158. A lip 162 extends generally horizontally along the upper edge 163 of rear wall 124 and projects upwardly from the rear wall 124. Lip 162 has a convex, generally arcuate profile configuration and is spaced rearwardly relative to the inner surface 164 of the rear wall 124. As in the embodiment described above, in connection with FIGS. 1 through 4, storage tray 112 is mounted upon mounting plate assembly 150 by inserting lip 162 into slot 160 to juxtapose the lip 162 with the upper rear surface 166 of the upper plate portion 156, and then bringing the outer surface 168 of the rear wall 124 into abutment with the lower front surface 170 of the lower plate portion 158, as illustrated in FIG. 7. The lower plate portion 158 is staggered rearwardly relative to the upper plate portion 156 and the rearward spacing of the lip 162 relative to the inner surface 164 of the rear wall 124 renders the inner surface 164 of the rear wall 124 essentially flush with the upper front surface 172 of the upper plate portion 156 for generally unrestricted access to the receptacle 120, as well as for an aesthetically pleasing appearance.

In the preferred arrangement, the mounting plate assembly 150 includes a front frame 180 and a rear plate 182. The front frame 180 has a plurality of circular races 184 and each race 184 receives a corresponding hub 152 along a complementary circular rim 188 which is integral with the upper and lower plate portions 156 and 158 of each hub 152 and is journaled for rotation in the corresponding race 184 about an axis of rotation R, generally normal to the mounting plate assembly 150. A plurality of detent projections 190 are integral with the hub 152 and project from the hub 152 rearwardly to engage complementary detent recesses 192 in the rear plate 182 so as to define fixed angular positions of the hub 152 relative to the mounting plate assembly 150. Mounting screws 194 extend through complementary screw holes 196 and 198 in the front frame 180 and in the rear plate 182, respectively, to mount the mounting plate assembly 150 on a vertical surface, such as vertical wall 200. Resilient cushions 202 isolate the storage tray 112 from the wall 200 to deter the transmission of vibrations from the wall 200 to the wine bottles 114 stored in the storage trays 112.

Once the mounting plate assembly 150 is secured to the wall 200, the storage trays 112 are affixed to the mounting plate assembly 150 by insertion of each lip 162 into a corresponding slot 160, as described above. It is noted that the upper and lower plate portions 156 and 158, respectively, of the hub 152 are angled so that the storage tray 112 projects from the mounting plate assembly 150 in a slightly upwardly angled direction to assist in retaining the wine bottle 114 properly in place in the storage tray 112. Upon selection of a wine bottle 114 for use, the corresponding storage tray 112 may be removed from the mounting plate assembly 150 along with the selected wine bottle 114, in which case the storage tray 112 may serve as a wine bottle holder at a wine serving location. To that end, the bottom wall 126 of the storage tray 112 includes a flat basal surface 210 for placement on a table or the like so that the storage tray 112 is employed as a stable holder for the wine bottle 114 at the serving location.

Figure 8:
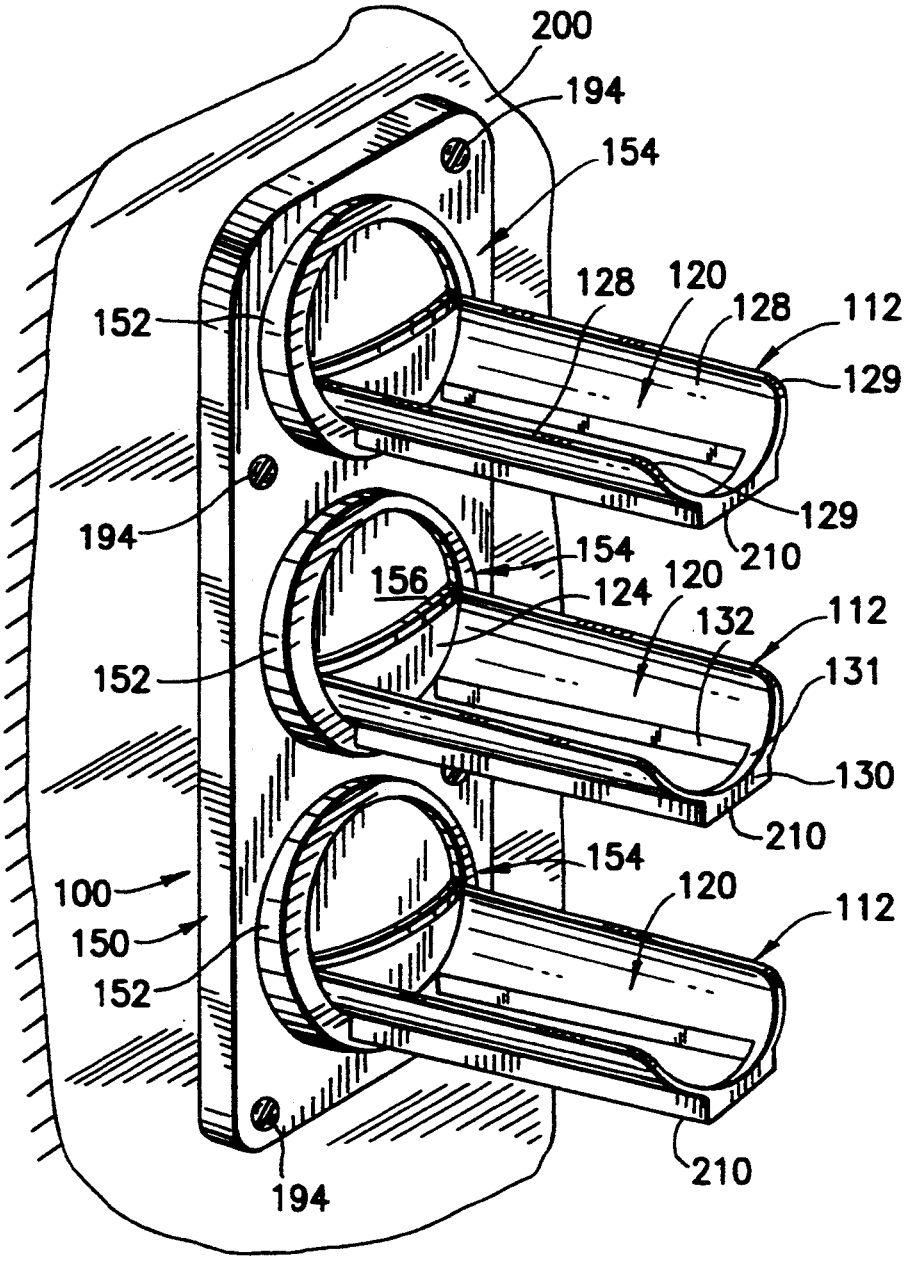
FIG. 8 is a perspective view showing an alternate arrangement of storage trays affixed to the mounting plate of the system of FIG. 5.

The mounting plate assembly 150 may be secured to wall 200 in any one of several orientations. As seen in FIG. 5, mounting plate assembly 150 is in a horizontal orientation and the storage trays 112 are arrayed along a horizontal direction. In FIG. 8, mounting plate assembly 150 is in a vertical orientation and the storage trays 112 are arrayed along a vertical direction. In order to accommodate the illustrated orientations, as well as other orientations in between those illustrated in FIGS. 5 and 8, the hubs 152 are rotated relative to the front frame 180 and rear plate 182 to one of the several positions provided by the detent projections 190 and detent recesses 192. Thus, wine rack 100 is versatile in use and makes available a variety of aesthetically pleasing arrangements at the option of the end user.

It will be seen that the present invention attains the several objects and advantages summarized above, namely: Enables a high degree of versatility for accommodating a wide variety of items to be stored in a storage tray system; provides maximum storage capacity in a minimum of space, with ease of access to items stored in the system; enables ease of securement and release of storage trays for any desired arrangement of trays, as well as for the transport of items in a tray to a remote location; provides optional tray covers for additional security and protection of the items being stored and transported; eases the accommodation of items of various dimensions for storage in the system and enables essentially unrestricted access to the items; provides an aesthetically pleasing appearance adapted for more widespread acceptance and use; enables a relatively simple construction for economical manufacture and relatively low cost; provides a rugged construction for exemplary performance over a long service life.

It is to be understood that the above detailed description of preferred embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. An improvement in a storage tray system in which a plurality of storage trays each include a receptacle bounded at least partially by a generally vertical wall having a generally vertical inner surface along the receptacle, an opposite outer surface and an upper peripheral edge, for enabling the mounting of a selected number of such trays in selected positions adjacent one another on an essentially vertical mounting plate, the improvement comprising:

a lip extending generally horizontally along at least a portion of the upper peripheral edge of the generally vertical wall and projecting vertically upwardly from the upper peripheral edge;

the mounting plate including an upper plate portion having an upper front surface and an upper rear surface located rearward of the upper front surface, a lower plate portion having a lower front surface and a lower rear surface located rearward of the lower front surface, and a generally horizontal slot between the upper plate portion and the lower plate portion;

the lower plate portion being staggered rearwardly relative to the upper plate portion, and the lip being spaced horizontally from the inner surface of the wall of the receptacle such that upon insertion of the lip into the slot with the lip juxtaposed with the upper rear surface of the upper plate portion, the inner surface of the wall of the receptacle is essentially flush with the upper front surface of the upper plate portion while the outer surface of the wall of the receptacle abuts the lower front surface of the lower plate portion to support the storage tray on the mounting plate.

2. The improvement of claim 1 wherein the lip includes an uppermost edge and the uppermost edge has a convex, generally arcuate profile configuration.

3. The improvement of claim 1 wherein the receptacle has a generally rectangular perimeter such that the wall of the receptacle includes four vertical wall portions extending serially around the perimeter of the receptacle, and the lip extends along at least two adjacent serial wall portions.

4. The improvement of claim 3 wherein the lip includes an uppermost edge and the uppermost edge has a convex, generally arcuate profile configuration along each of the two adjacent serial wall portions.

5. The improvement of claim 3 wherein the lip extends along all four wall portions, the improvement including a cover member having a rectangular perimeter complementary to the generally rectangular perimeter of the receptacle and including four sides, and a channel extending along two adjacent sides, the channel being complementary to the lip for receiving corresponding portions of the lip within the channel to secure the cover on the receptacle.

6. The improvement of claim 1 including a cover member complementary to the receptacle for selective closing of the receptacle, the cover member having a perimeter and a channel extending along at least a portion of the perimeter, the channel being complementary to the lip such that the lip is received within the channel to secure the cover on the receptacle.

7. The improvement of claim 1 wherein the mounting plate includes:

a further plate portion having a further front surface and a further rear surface located rearward of the further front surface, and a generally horizontal further slot between the lower plate portion and the further plate portion;

the further plate portion being staggered rearwardly relative to the lower plate portion, and the lip being spaced horizontally from the inner surface of the wall of the receptacle such that upon insertion of the lip into the further slot with the lip juxtaposed with the lower rear surface of the lower plate portion, the inner surface of the wall of the receptacle is essentially flush with the lower front surface of the lower plate portion while the outer surface of the wall of the receptacle abuts the further front surface of the further plate portion to support the storage tray on the mounting plate.

8. The improvement of claim 1 wherein the receptacle has a concave, semi-cylindrical cross-sectional configuration in planes generally parallel to the mounting plate, the receptacle including an opening opposite the generally vertical wall for holding an item in the receptacle, with the item extending through the opening, beyond the receptacle.

9. The improvement of claim 8 wherein the receptacle includes a bottom, and an elongate aperture in the bottom of the receptacle.

10. The improvement of claim 8 wherein the mounting plate includes a generally circular rim integral with the plate portions, and a race complementary to the rim, the rim being journaled for selective rotation within the race about an axis of rotation extending generally normal to the mounting plate so as to enable selective orientation of the receptacle relative to the mounting plate about the axis of rotation.

11. The improvement of claim 10 including detent means for securing the receptacle in a selected orientation.

* * * * *